US011839582B2

(12) United States Patent
Liu

(10) Patent No.: US 11,839,582 B2
(45) Date of Patent: Dec. 12, 2023

(54) WEARABLE MASSAGER

(71) Applicant: DANXIAO INFORMATION TECHNOLOGY LTD., Guangdong (CN)

(72) Inventor: Dan Liu, Guangzhou (CN)

(73) Assignee: DANXIAO INFORMATION TECHNOLOGY LTD., Guangdong (CN)

( * ) Notice: Subject to any disclaimer, the term of this patent is extended or adjusted under 35 U.S.C. 154(b) by 0 days.

(21) Appl. No.: 17/871,298

(22) Filed: Jul. 22, 2022

(65) Prior Publication Data

US 2022/0354733 A1 Nov. 10, 2022

Related U.S. Application Data

(63) Continuation of application No. 16/835,808, filed on Mar. 31, 2020, now Pat. No. 11,452,669.

(60) Provisional application No. 62/830,195, filed on Apr. 5, 2019.

(51) Int. Cl.
*A61H 19/00* (2006.01)
*A61H 23/02* (2006.01)

(52) U.S. Cl.
CPC ..... *A61H 19/30* (2013.01); *A61H 23/02* (2013.01); *A61H 2201/0119* (2013.01); *A61H 2201/165* (2013.01); *A61H 2201/501* (2013.01); *A61H 2201/5048* (2013.01); *A61H 2201/5097* (2013.01)

(58) Field of Classification Search
CPC ..... A61H 19/30; A61H 2201/165; A61H 2201/501; A61H 2201/5097; A61H 2205/087
See application file for complete search history.

(56) References Cited

U.S. PATENT DOCUMENTS

| | | | | |
|---|---|---|---|---|
| 5,943,214 | A * | 8/1999 | Sato | H02K 11/40 361/809 |
| 2003/0181784 | A1* | 9/2003 | Klein | A61H 19/34 600/38 |
| 2008/0009775 | A1* | 1/2008 | Murison | A61H 19/50 600/38 |
| 2013/0165747 | A1 | 6/2013 | Maggs | |
| 2017/0119619 | A1 | 5/2017 | Dills | |
| 2018/0116904 | A1 | 5/2018 | Lieberman et al. | |
| 2020/0069511 | A1* | 3/2020 | Lopez | G06F 3/016 |

* cited by examiner

*Primary Examiner* — Christine H Matthews
(74) *Attorney, Agent, or Firm* — Holtz, Holtz & Volek PC

(57) ABSTRACT

A massaging device such as a wearable massager may include a moveable cover, a first magnet, a second magnet, a first shell, a second shell, a printed circuit board, a motor, and a battery. The wearable massager may be operated to provide a massaging effect to a wearer of the massager at a desired body part location at a desired time.

21 Claims, 6 Drawing Sheets

WEARABLE MASSAGER

CROSS REFERENCE TO RELATED APPLICATION

This application is a continuation of U.S. patent application Ser. No. 16/835,808, filed on Mar. 31, 2020, which claims the benefit of U.S. Provisional Application No. 62/830,195, filed on Apr. 5, 2019, the entire contents of all of which are hereby incorporated by reference as if fully set forth herein.

FIELD OF THE INVENTION

The present disclosure generally relates to a massaging device. Specifically, the present disclosure is directed toward a wearable massager. The wearable massager may be operated to provide a massaging effect to a wearer of the massager at a desired body part location at a desired time.

BACKGROUND OF THE DISCLOSURE

Massaging devices may be utilized for a variety of uses including, for example, to stimulate specified areas on a user body. However, conventional massaging devices do not include sufficient features for providing a massaging effect to users in a discreet or efficient manner and/or at predetermined times and locations.

Therefore, there is a need in the art for a massaging device configured to provide a massaging effect to users in a discreet or efficient manner and/or at predetermined times and locations. These and other features and advantages of the present invention will be explained and will become obvious to one skilled in the art through the summary of the invention that follows.

BRIEF DESCRIPTION OF THE DRAWINGS

Accompanying this written specification is a collection of drawings of exemplary embodiments of the present disclosure. One of ordinary skill in the art would appreciate that these are merely exemplary embodiments, and additional and alternative embodiments may exist and still within the spirit of the disclosure as described herein.

DETAILED DESCRIPTION AND INDUSTRIAL APPLICABILITY

Figure 1:
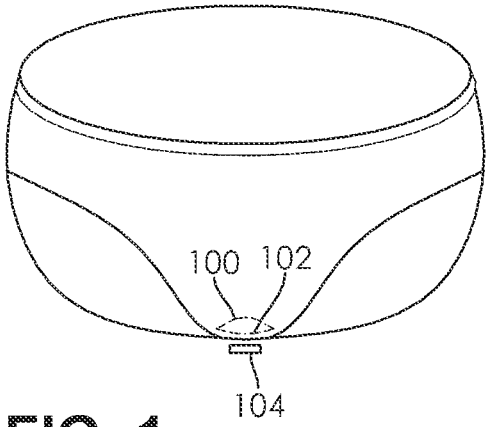
FIG. 1 shows a wearable massager device on an exemplary article of clothing in accordance with an embodiment of the present invention.

The exemplary disclosed apparatus, system, and method may include a massaging device such as a wearable massager. The wearable massager may be worn for example in male or female underpants and/or any other desired clothing, garment, or accessory. The exemplary massager may include any suitable vibrational components for providing a massaging effect of the massager to a user (e.g., wearer).

According to embodiments of the present invention, a wearable massager may comprise a main body section comprising a shell formed to encase one or more vibrational components, an interior attachment member, and a printed circuit board, and a connector comprising an exterior attachment member corresponding to and able to connect with the interior attachment member. In some embodiments, the interior and exterior attachment members of the wearable massager are magnets. In some embodiment, a button may disposed on the main body section and may be used to selectively activate the wearable massager. In some embodiments, the printed circuit board of the wearable massager transmits vibrational data. In some embodiments, connecting the interior attachment member to the exterior attachment member facilitates the attachment of the wearable massager to an article of clothing.

According to embodiments of the present invention, a wearable massager may comprise a main body section comprising a shell formed to encase a motor, a battery, one or more vibrational components, an interior magnet member, and a printed circuit board for transmitting vibrational data, and a connector comprising an exterior magnet member configured to selectively attract the interior magnet member. In some embodiments, the printed circuit board includes conductive elements connected to the motor. In some embodiments, the connection of the interior magnet member to the exterior magnet member facilitates the attachment of the wearable massager to an article of clothing disposed between the interior and exterior magnet members. In some embodiments, activation of the vibrational components causes the wearable massager to vibrate. In some embodiments, a computing device selectively activates the vibrational components of the wearable massager. In some embodiments, the computing device is a smart phone. In some embodiments, vibrational data is transmitted from the smart phone to the wearable massager via short-range wireless communication (e.g., Bluetooth® and the like).

According to embodiments of the present invention, a wearable massager may comprise a main body section comprising a shell having an external upward protrusion and formed to encase a motor, a battery, one or more vibrational components, an interior magnet member, and a printed circuit board for transmitting vibrational data, a connector comprising an exterior magnet member configured to selectively attract the interior magnet member. In some embodiments, the connection of the interior magnet member to the exterior magnet member facilitates the attachment of the wearable massager to an article disposed between the interior and exterior magnet members. In some embodiments, the external upward protrusion is a point of contact for a human body (for example perineum or vagina). In some embodiments, the vibrational components are selectively activated by a computing device. In some embodiments, the vibrational components are selectively activated by a remote user via the computing device. In some embodiments, the computing device includes a sound sensor configured to activate the vibrational components. In some embodiments, the computing device includes a timer configured to activate the vibrational components upon reaching a selected time.

FIG. 1 illustrates a front view of an exemplary massager that may be disposed in exemplary clothing such as underpants (without a human body being shown for the sake of clarity). As illustrated in FIG. 1, the massager 100 may be disposed in an exemplary pair of underpants, and an exterior magnet 104 may be disposed outside the underpants. The portion of the exemplary wearable massager 100 that is within the exemplary underpants would not be seen by an observer, but is shown in FIG. 1 using broken lines to demonstrate an exemplary placement of the wearable massager 100. An interior magnet 102 may be disposed in the massager 100. In some examples, the interior magnet 102 may be disposed partially or substantially entirely within or inside of the massager 100. The interior magnet 102 and the exterior magnet 104 may operate together to hold the massager 100 in a desired location. For example, the exterior magnet 104 and the interior magnet 102 may press against both sides of exemplary underpants or other clothing or garments to hold the massager 100 in place based on the exterior magnet 104 and interior magnet 102 magnetically attracting together. In some scenarios, the exterior magnet 104 and interior magnet 102 may for example hold the massager at a female's vaginal opening, an anal area of a male or female, or any other desired body part of a wearer of the massager 100. In at least some exemplary embodiments, the exterior magnet 104 may be attached or fixed in or on a moveable cover 106. In any embodiment, the moveable cover 106 may be a connector. The connector may be configured to connect the massager 100 to an article, for example, an article of clothing.

Figure 2:
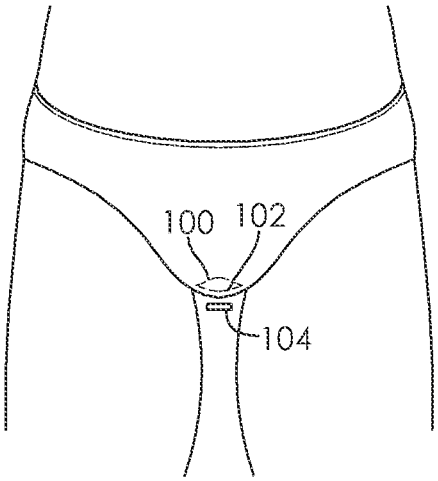
FIG. 2 shows a wearable massager device on an exemplary article of clothing in accordance with an embodiment of the present invention.

FIG. 2 illustrates a front view of an exemplary massager and exemplary clothing such as underpants. The depicted example includes a human body for the purpose of demonstrating an exemplary environment for the massager 100. The portion of the exemplary wearable massager 100 that is within the exemplary underpants would not be seen by an observer, but is shown in FIG. 1 using broken lines to demonstrate an exemplary placement of the wearable massager 100. As illustrated in FIG. 2, a human of any given gender may wear clothing, for example, underpants, with a wearable massager 100. In some scenarios, the massager 100 may be held in place on a desired sexually sensitive area. In some examples, the massager 100 may be held in place in any other desired placement or position. In any embodiment, a user may utilize the massager 100 while laying, sitting, standing, moving, or partaking in any other activity, in any other position.

Figure 3:
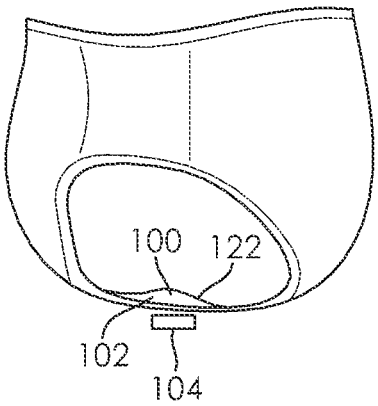
FIG. 3 shows a wearable massager device on an exemplary article of clothing in accordance with an embodiment of the present invention.

FIG. 3 illustrates a side view of an exemplary massager and underpants (without a human body being shown for the sake of clarity). As illustrated in FIG. 3, the massager 100 may have a convex massaging unit or upward protrusion structure 122 that may be used to massage a person's sensitive spots. In some examples, the protrusion structure 122 may be used to massage sexually sensitive locations, for example, portions of human genitalia.

Figure 4:
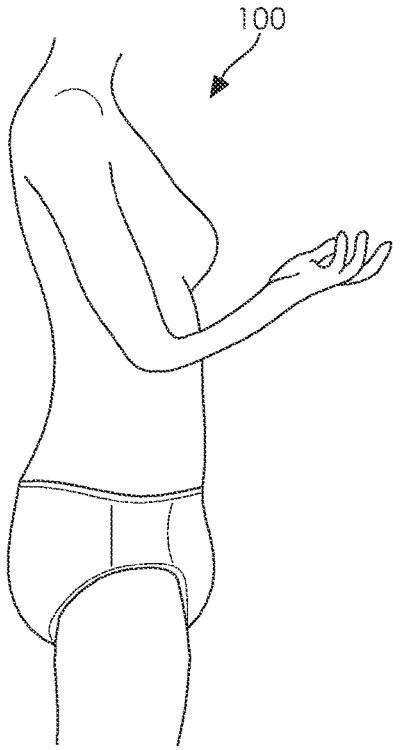
FIG. 4 shows an exemplary user wearing the wearable massager device, where the massager is discreet and cannot be seen, in accordance with an embodiment of the present invention.

FIG. 4 illustrates a side view of an exemplary massager and exemplary clothing such as underpants with a human body being depicted. As illustrated in FIG. 4, an exemplary wearable massager 100 may be worn to provide privacy and concealment of the wearable massager 100. For example, the exemplary wearable massager 100 may not be visible to individuals looking at a human or model wearing the exemplary massager 100. In some scenarios, a user, for example, a person, wearing the exemplary wearable massager 100 may go to any desired location and/or engage in any desired activity without others viewing the wearable massager 100 (e.g., as if the user of the wearable massager did not appear to be wearing the device).

The exemplary wearable massager may be controlled via a remote (e.g., by a wireless remote such as a connected wireless remote). In some examples, the exemplary wearable massager 100 may be controlled by a smart phone via short-range wireless communication (e.g., Bluetooth®, infrared communication, and the like). The exemplary wearable massager 100 may be connected to the Internet, which may allow the exemplary wearable massager 100 to be controlled by another person who is in a different location from an individual wearing the exemplary massager 100.

Figure 5:
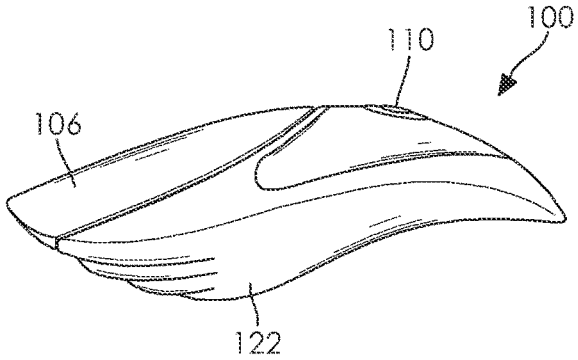
FIG. 5 shows a side view of a wearable massager device in accordance with an embodiment of the present invention.

FIG. 5 illustrates a side view (e.g., down side view) of an exemplary wearable massager. As illustrated in FIG. 5, the exemplary wearable massager 100 may include a moveable cover 106 and a button 110 disposed on a main body of the exemplary massager 100. Both the moveable cover 106 and the main body of the massager may include magnets. In some examples, the moveable cover 106 and the main body of the massager may include other releasable fasteners, for example, snap-on clips, hook and loop fasteners or any suitable releasable fasteners. In some scenarios, the moveable cover 106 may be attracted to the main body of the massager by the releasable fasteners, for example, the exemplary magnets. In some examples, the moveable cover 106 may additionally or alternatively be retained on the main body of the massager by the releasable fasteners, for example, the exemplary magnets.

Figure 6:
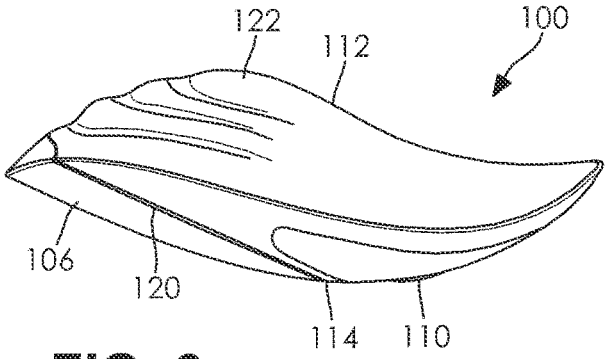
FIG. 6 shows a side view of a wearable massager device in accordance with an embodiment of the present invention.

FIG. 6 illustrates a side view (e.g., up side view) of an exemplary wearable massager. As illustrated in FIG. 6, the exemplary wearable massager 100 may include a moveable cover 106 and a button 110 disposed on the main body of the massager 100. Both the moveable cover 106 and the main body of the massager 100 may include magnets. In some examples, the moveable cover 106 may include the exterior magnet 104 and the main body of the massager 100 may include the interior magnet 102. The moveable cover 106 may be attracted to and/or retained on the main body of the massager 100 by the exemplary magnets (e.g., similarly to as described above). The exemplary wearable massager 100 may include one or more sides. In the depicted example, the exemplary wearable massager 100 includes a near body side 112 and an away body side 114. The near body side 112 of the exemplary wearable massager 100 may be close-fitting to a user, for example, a human body. The away body side 114 of the wearable massager may be an opposite side of the exemplary massager 100 to the near body side 112 of the wearable massager 100. The near body side 112 of the exemplary wearable massager 100 may be configured as an upward protrusion structure 122. In some embodiments, the upward protrusion structure 122 is a bulge structure. In some examples, the bulge structure is laminated. The bulge structure may be an ergonomic design that may provide a comfortable sense or natural feeling to a user, for example, a human, wearing the exemplary massager 100.

Figure 7:
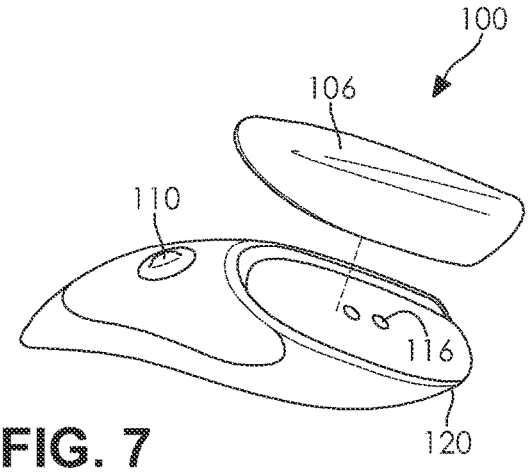
FIG. 7 shows a perspective view of a wearable massager device with the moveable cover detached in accordance with an embodiment of the present invention.

FIG. 7 illustrates an exploded view of an exemplary wearable massager. As illustrated in FIG. 7, a charging connector 116 may be disposed in the main body of the massager 100. The exemplary charging connector 116 may be selectively covered by the moveable cover 106. The exemplary charging connector 116 may be used to connect a charging cable (not shown) to the wearable massager 100. In some examples, a charging connector (not shown) may connect to the charging connector 116 to power or charge a battery 118 of the wearable massager 100. A gap 120 may be formed between the exemplary moveable cover 106 and the main body of the massager 100 when the moveable cover 106 is placed on or attached to the main body. When the wearable massager 100 is used, for example, when the massager is worn by a user, the gap 120 may be filled with clothing of the wearer. In an exemplary usage scenario, the gap 120 may be filled with a lower part of underpants of the human wearer.

Figure 8:
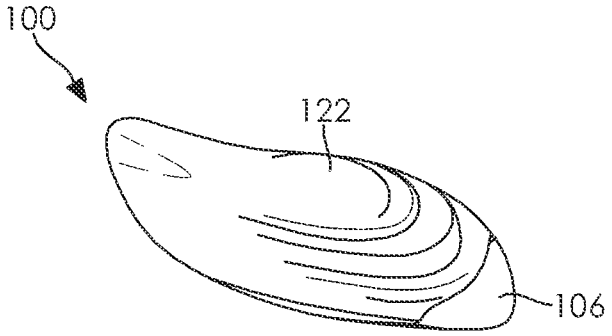
FIG. 8 shows a top perspective view of a wearable massager device in accordance with an embodiment of the present invention.

FIG. 8 illustrates a surface (e.g., surface portion) of an exemplary wearable massager. As illustrated in FIG. 8, an exemplary near body side 112 of the surface of the exemplary wearable massager 100 may be configured to have an upward protrusion structure 122. In some examples, the upward protrusion structure 122 may be upwardly protruding and/or outwardly protruding. A height of the upward protrusion structure 122 may be between about 0.5 mm and about 2 mm. In at least some exemplary embodiments, the height of the upward protrusion structure 122 may be about 1 mm. In some embodiments, the surface of the moveable cover 106 may include a concave structure 124 which may be configured as downwardly or inwardly caved.

Figure 9A:
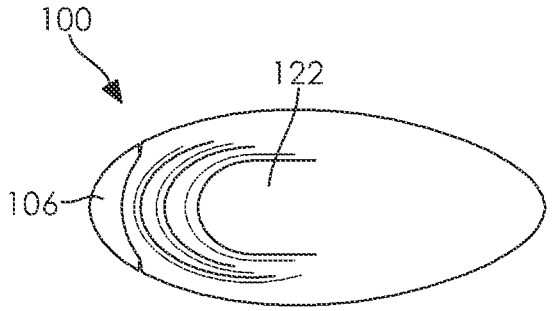
FIG. 9A shows a top view of a wearable massager device in accordance with an embodiment of the present invention.
Figure 9B:
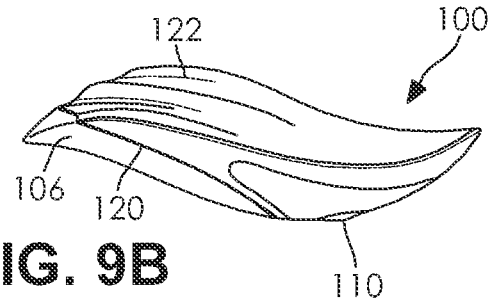
FIG. 9B shows a side view of a wearable massager device in accordance with an embodiment of the present invention.
Figure 9C:
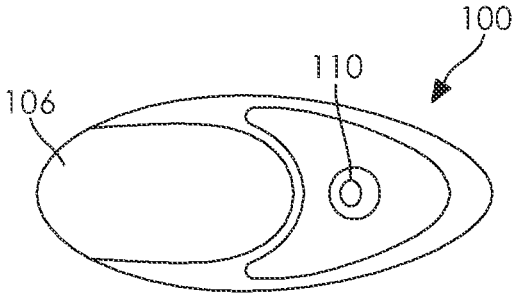
FIG. 9C shows a bottom view of a wearable massager device in accordance with an embodiment of the present invention.

FIGS. 9A, 9B, and 9C illustrate exemplary views of an exemplary wearable massager. As illustrated in FIGS. 9A, 9B, and 9C, the exemplary massager 100 may be configured or dimensioned in any suitable way to comfortably fit a human body. For example, a width of the exemplary wearable massager may range between about 30 mm and about 50 mm. In at least some exemplary embodiments, the width may be about 40 mm. Also, for example, a length of the exemplary wearable massager 100 may range between about 90 mm and about 100 mm. In at least some exemplary embodiments, the length may be about 92.5 mm. Further for example, a height of the exemplary wearable massager 100 may range between about 20 mm and about 30 mm. In at least some exemplary embodiments, the height may be about 26.5 mm.

Figure 10:
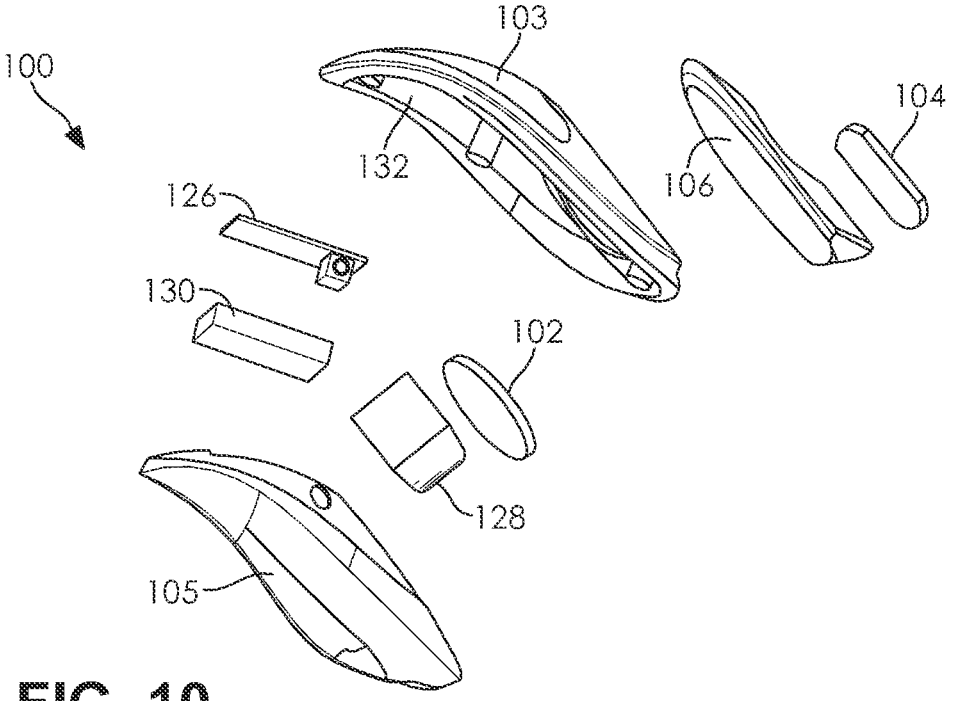
FIG. 10 shows an exploded view of a wearable massager device in accordance with an embodiment of the present invention.

FIG. 10 illustrates exemplary structural details of the exemplary disclosed massager. As illustrated in FIG. 10, the exemplary wearable massager 100 may include a moveable cover 106, an interior magnet 102, an exterior magnet 104, a first shell 103, a second shell 105, a printed circuit board (PCB) 126, a motor 128, and a battery 130. The exemplary massager 100 may include any suitable vibrational components for providing a massaging effect of the massager to a user. The exemplary moveable cover 106 may be removably attached to the main body of the exemplary massager 100. In an exemplary usage scenario, the moveable cover 106 may be removed from the main body of the exemplary wearable massager. The exemplary exterior magnet 104 may be disposed on the moveable cover 106, which may move away from the main body of the wearable massager 100. The exemplary interior magnet 102 may be disposed or positioned on or partially or substantially entirely in the main body of the exemplary wearable massager 100. The interior magnet 102 may be any shape including circular, square, rectangular or ring-shaped. In the illustrated example, the interior magnet 102 is ring-shaped. The exemplary first shell 103 of the main body may removably receive the moveable cover 106. The moveable cover 106 may be fitted on the exemplary first shell 103 of the main body via the attractive force of the interior and exterior magnets 102 and 104. The exemplary second shell 105 of the main body may form a cavity 132 together with the exemplary first shell 103 of the main body. The PCB126 may be positioned in the exemplary cavity 132 that may be formed by the first shell 103 of the main body and second shell 105 of the main body. The exemplary motor 128 may be positioned in the exemplary cavity 132 that may be formed by the first shell 103 and second shell 105 of the main body. The exemplary battery 130 may be positioned in the cavity 132 that may be formed by the first shell 103 of the main body and second shell 105 of the main body.

In at least some exemplary embodiments, when the exterior magnet 104, which may be positioned on the moveable cover 106, and the interior magnet 102, which may be positioned in the cavity 132 that may be formed by the first shell 103 of the main body and second shell 105 of the main body, are attracted to each other, the moveable cover 106 and the main body may be attracted together, which may thereby hold the exemplary wearable massager 100 in a stable position, for example, in a user's desired position.

In at least some exemplary embodiments, the exemplary disclosed system and method may provide output and receive input from a system operator, one or more users of the system, and/or a wearer of the exemplary massager. For example, the exemplary disclosed system and method may operate using computing devices and networks similar to the exemplary devices and networks described below regarding FIGS. 13-15. In at least some exemplary embodiments, users may access the system using a smart phone app.

Figure 11:
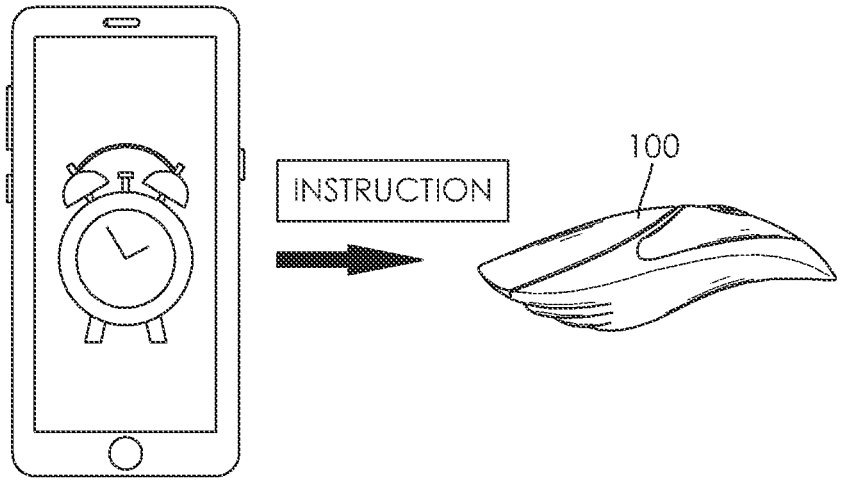
FIG. 11 illustrates an exemplary operation of a wearable massager device in accordance with an embodiment of the present invention.

FIG. 11 illustrates an exemplary operation of the exemplary massager. For example, an app of the exemplary system may set a predetermined time to initiate an operation of the wearable massager. In some scenarios, an app of the exemplary system may set a predetermined time to initiate an alarm, for example, as an alarm clock. In a first step, the wearable massager 100 may be connected to a user interface. For example, the wearable massager 100 may be connected to a smart phone via Bluetooth® or any other suitable communication technique. In a second step, a user may set up alarm options and wear the wearable massager 100. In a third step, a user interface such as a smart phone may send an instruction to activate the exemplary wearable massager 100 when a predetermined amount of time has elapsed or a predetermined time is reached.

Figure 12:
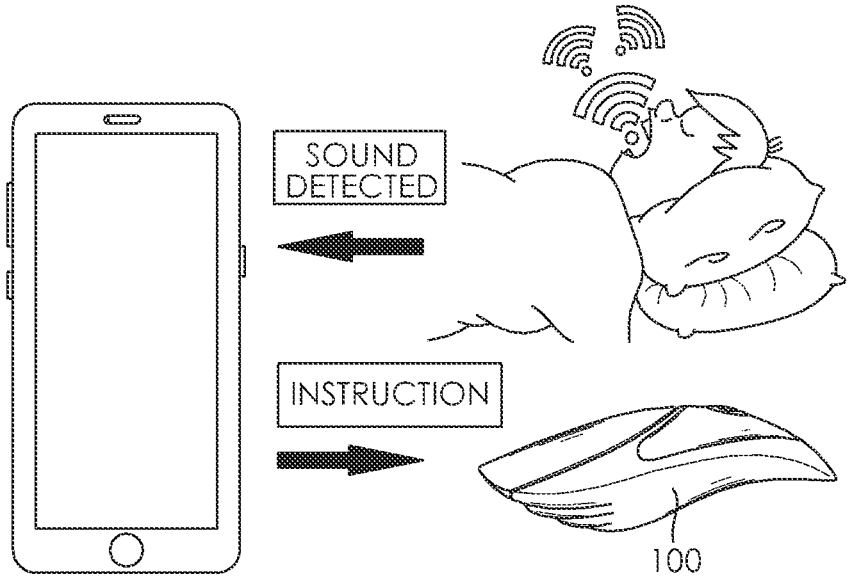
FIG. 12 illustrates an exemplary operation of a wearable massager device in accordance with an embodiment of the present invention.

FIG. 12 illustrates another exemplary operation of the exemplary massager. The exemplary wearable massager 100 may be for example controlled by sound via any suitable user interface such as through a smartphone app. The system, for example, an app of the exemplary system, may send an instruction to activate the wearable massager 100 when a predetermined sound is detected. In some examples, a sound such as snoring, predetermined patterns of breathing, and/or any other desired sound may send an instruction to activate the wearable massager 100. In a first step, the exemplary wearable massager 100 may be connected to an exemplary user interface, for example, to a smart phone via Bluetooth®. In a second step, a sound detection feature may be started or initiated using the user interface, for example, by using a smart phone app of the exemplary system to detect sounds such as snoring. In a third step, the system may send an instruction to activate the exemplary wearable massager 100 when a user interface such as a smart phone has detected a predetermined sound such as snoring.

The exemplary disclosed system and method may be used in any suitable application involving providing a massaging effect. For example, the exemplary disclosed system and method may be used in any suitable application such as massaging devices including wearable massaging devices.

The exemplary disclosed system and method may provide an efficient and effective technique for providing a massaging effect to a user. The exemplary disclosed system and method may allow for a massaging effect to be provided to a user wearing a massaging device at a desired body part at a desired time.

Figure 13:
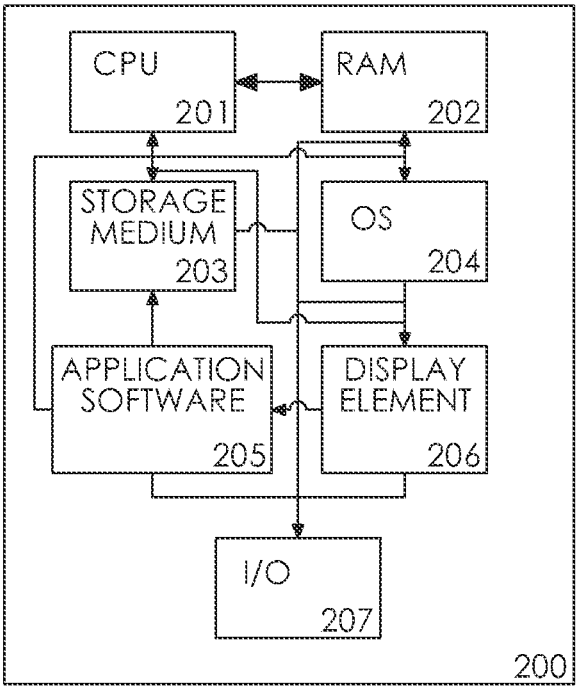
FIG. 13 is a schematic illustration of an exemplary computing device, in accordance with at least some exemplary embodiments of the present disclosure.

An illustrative representation of a computing device appropriate for use with embodiments of the system of the present disclosure is shown in FIG. 13. The computing device 200 can generally be comprised of a Central Processing Unit (CPU, 201), optional further processing units including a graphics processing unit (GPU), a Random Access Memory (RAM, 202), a mother board 203, or alternatively/additionally a storage medium (e.g., hard disk drive, solid state drive, flash memory, cloud storage), an operating system (OS, 204), one or more application software 105, a display element 206, and one or more input/output devices/means 207, including one or more communication interfaces (e.g., RS232, Ethernet, Wifi, Bluetooth®, USB). Useful examples include, but are not limited to, personal computers, smart phones, laptops, mobile computing devices, tablet PCs, and servers. Multiple computing devices can be operably linked to form a computer network in a manner as to distribute and share one or more resources, such as clustered computing devices and server banks or farms.

Various examples of such general-purpose multi-unit computer networks suitable for embodiments of the disclosure, their typical configuration and many standardized communication links are well known to one skilled in the art, as explained in more detail and illustrated by FIG. 14, which is discussed herein-below.

According to an exemplary embodiment of the present disclosure, data may be transferred to the system, stored by the system and/or transferred by the system to users of the system across local area networks (LANs) (e.g., office networks, home networks) or wide area networks (WANs) (e.g., the Internet). In accordance with the previous embodiment, the system may be comprised of numerous servers communicatively connected across one or more LANs and/or WANs. One of ordinary skill in the art would appreciate that there are numerous manners in which the system could be configured and embodiments of the present disclosure are contemplated for use with any configuration.

In general, the system and methods provided herein may be employed by a user of a computing device whether connected to a network or not. Similarly, some steps of the methods provided herein may be performed by components and modules of the system whether connected or not. While such components or modules are offline, and the data they generated will then be transmitted to the relevant other parts of the system once the offline component or module comes again online with the rest of the network (or a relevant part thereof). According to an embodiment of the present disclosure, some of the applications of the present disclosure may not be accessible when not connected to a network, however a user or a module or component of the system itself may be able to compose data offline from the remainder of the system that will be consumed by the system or its other components when the user/offline system component or module is later connected to the system network.

Figure 14:
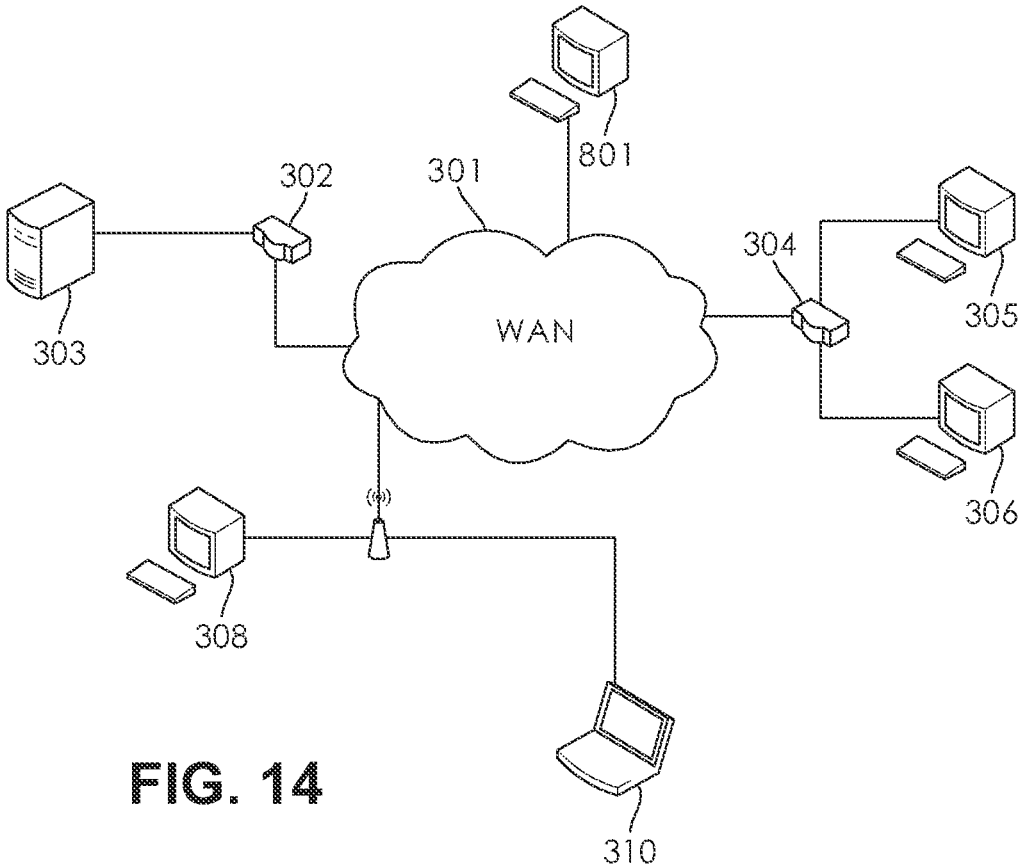
FIG. 14 is a schematic illustration of an exemplary network, in accordance with at least some exemplary embodiments of the present disclosure.

Referring to FIG. 14, a schematic overview of a system in accordance with an embodiment of the present disclosure is shown. The system is comprised of one or more application servers 303 for electronically storing information used by the system. Applications in the server 303 may retrieve and manipulate information in storage devices and exchange information through a WAN 301 (e.g., the Internet). Applications in server 303 may also be used to manipulate information stored remotely and process and analyze data stored remotely across a WAN 301 (e.g., the Internet).

According to an exemplary embodiment, as shown in FIG. 14, exchange of information through the WAN 301 or other network may occur through one or more high speed connections. In some cases, high speed connections may be over-the-air (OTA), passed through networked systems, directly connected to one or more WANs 301 or directed through one or more routers 302. Router(s) 302 are completely optional and other embodiments in accordance with the present disclosure may or may not utilize one or more routers 302. One of ordinary skill in the art would appreciate that there are numerous ways server 303 may connect to WAN 301 for the exchange of information, and embodiments of the present disclosure are contemplated for use with any method for connecting to networks for the purpose of exchanging information. Further, while this application refers to high speed connections, embodiments of the present disclosure may be utilized with connections of any speed.

Components or modules of the system may connect to server 303 via WAN 301 or other network in numerous ways. For instance, a component or module may connect to the system i) through a computing device 312 directly connected to the WAN 301, ii) through a computing device 305, 306 connected to the WAN 301 through a routing device 304, iii) through a computing device 308, 309, 310 connected to a wireless access point 307 or iv) through a computing device 311 via a wireless connection (e.g., CDMA, GMS, 3G, 4G) to the WAN 201. One of ordinary skill in the art will appreciate that there are numerous ways that a component or module may connect to server 303 via WAN 301 or other network, and embodiments of the present disclosure are contemplated for use with any method for connecting to server 303 via WAN 301 or other network. Furthermore, server 303 could be comprised of a personal computing device, such as a smart phone, acting as a host for other computing devices to connect to.

The communications means of the system may be any means for communicating data, including image and video, over one or more networks or to one or more peripheral devices attached to the system, or to a system module or component. Appropriate communications means may include, but are not limited to, wireless connections, wired connections, cellular connections, data port connections, short-range wireless connections (e.g., Bluetooth® connections, near field communications (NFC) connections, infrared communication, and the like), or any combination thereof of these communication means. One of ordinary skill in the art will appreciate that there are numerous communications means that may be utilized with embodiments of the present disclosure, and embodiments of the present disclosure are contemplated for use with any communications means.

Figure 15:
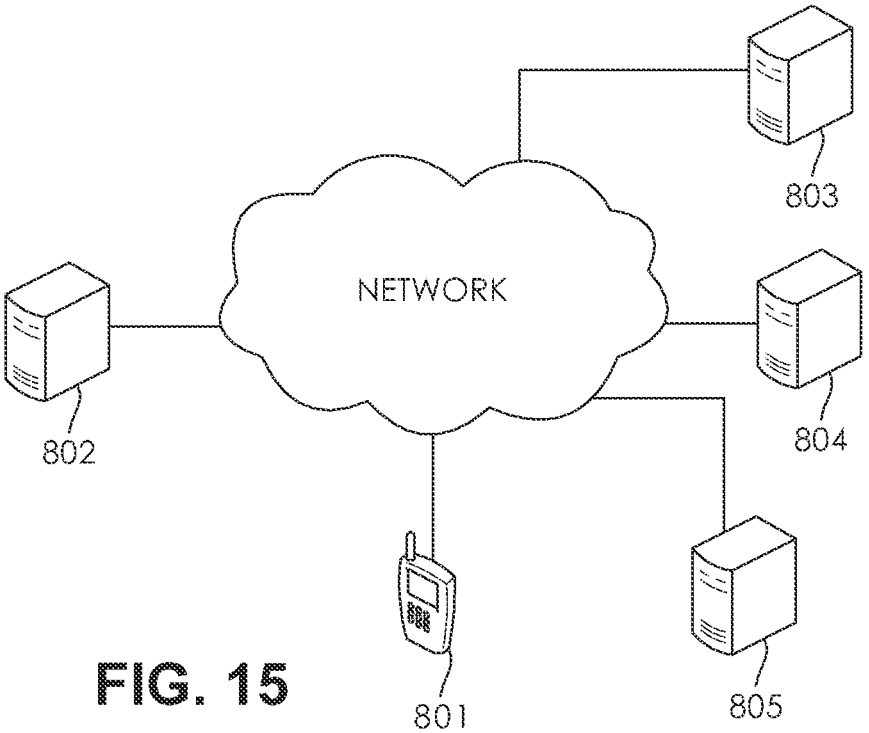
FIG. 15 is a schematic illustration of an exemplary network, in accordance with at least some exemplary embodiments of the present disclosure.

Turning now to FIG. 15, a continued schematic overview of a cloud-based system in accordance with an embodiment of the present invention is shown. In FIG. 15, the cloud-based system is shown as it may interact with users and other third party networks or APIs. For instance, a user of a mobile device 801 may be able to connect to application server 802. Application server 802 may be able to enhance or otherwise provide additional services to the user by requesting and receiving information from one or more of an external content provider API/website or other third party system 803, a constituent data service 804, one or more additional data services 805 or any combination thereof. Additionally, application server 802 may be able to enhance or otherwise provide additional services to an external content provider API/website or other third party system 803, a constituent data service 804, one or more additional data services 805 by providing information to those entities that is stored on a database that is connected to the application server 802. One of ordinary skill in the art would appreciate how accessing one or more third-party systems could augment the ability of the system described herein, and embodiments of the present invention are contemplated for use with any third-party system.

Traditionally, a computer program includes a finite sequence of computational instructions or program instructions. It will be appreciated that a programmable apparatus or computing device can receive such a computer program and, by processing the computational instructions thereof, produce a technical effect.

A programmable apparatus or computing device includes one or more microprocessors, micro controllers, embedded micro controllers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computing device can include any and all suitable combinations of at least one general purpose computer, special-purpose computer, programmable data processing apparatus, processor, processor architecture, and so on. It will be understood that a computing device can include a computer-readable storage medium and that this medium may be internal or external, removable and replaceable, or fixed. It will also be understood that a computing device can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the disclosure as claimed herein could include an optical computer, quantum computer, analog computer, or the like.

Regardless of the type of computer program or computing device involved, a computer program can be loaded onto a computing device to produce a particular machine that can perform any and all of the depicted functions. This particular machine (or networked configuration thereof) provides a technique for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Illustrative examples of the computer readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A data store may be comprised of one or more of a database, file storage system, relational data storage system or any other data system or structure configured to store data. The data store may be a relational database, working in conjunction with a relational database management system (RDBMS) for receiving, processing and storing data. A data store may comprise one or more databases for storing information related to the processing of moving information and estimate information as well one or more databases configured for storage and retrieval of moving information and estimate information.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software components or modules, or as components or modules that employ external routines, code, services, and so forth, or any combination of these. All such implementations are within the scope of the present disclosure. In view of the foregoing, it will be appreciated that elements of the block diagrams and flowchart illustrations support combinations of means for performing the specified functions, combinations of steps for performing the specified functions, program instruction technique for performing the specified functions, and so on.

It will be appreciated that computer program instructions may include computer executable code. A variety of languages for expressing computer program instructions are possible, including without limitation C, C++, Java, JavaScript, assembly language, Lisp, HTML, Perl, and so on. Such languages may include assembly languages, hardware description languages, database programming languages, functional programming languages, imperative programming languages, and so on. In some embodiments, computer program instructions can be stored, compiled, or interpreted to run on a computing device, a programmable data processing apparatus, a heterogeneous combination of processors or processor architectures, and so on. Without limitation, embodiments of the system as described herein can take the form of web-based computer software, which includes client/server software, software-as-a-service, peer-to-peer software, or the like.

In some embodiments, a computing device enables execution of computer program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computing device can process these threads based on priority or any other order based on instructions provided in the program code.

Unless explicitly stated or otherwise clear from the context, the verbs "process" and "execute" are used interchangeably to indicate execute, process, interpret, compile, assemble, link, load, any and all combinations of the foregoing, or the like. Therefore, embodiments that process computer program instructions, computer-executable code, or the like can suitably act upon the instructions or code in any and all of the ways just described.

The functions and operations presented herein are not inherently related to any particular computing device or other apparatus. Various general-purpose systems may also be used with programs in accordance with the teachings herein, or it may prove convenient to construct more specialized apparatus to perform the required method steps. The required structure for a variety of these systems will be apparent to those of ordinary skill in the art, along with equivalent variations. In addition, embodiments of the disclosure are not described with reference to any particular programming language. It is appreciated that a variety of programming languages may be used to implement the present teachings as described herein, and any references to specific languages are provided for disclosure of enablement and best mode of embodiments of the disclosure. Embodiments of the disclosure are well suited to a wide variety of computer network systems over numerous topologies. Within this field, the configuration and management of large networks include storage devices and computing devices that are communicatively coupled to dissimilar computing and storage devices over a network, such as the Internet, also referred to as "web" or "world wide web".

In at least some exemplary embodiments, the exemplary disclosed system may utilize sophisticated machine learning and/or artificial intelligence techniques to prepare and submit datasets and variables to cloud computing clusters and/or other analytical tools (e.g., predictive analytical tools) which may analyze such data using artificial intelligence neural networks. The exemplary disclosed system may for example include cloud computing clusters performing predictive analysis. For example, the exemplary neural network may include a plurality of input nodes that may be interconnected and/or networked with a plurality of additional and/or other processing nodes to determine a predicted result. Exemplary artificial intelligence processes may include filtering and processing datasets, processing to simplify datasets by statistically eliminating irrelevant, invariant or superfluous variables or creating new variables which are an amalgamation of a set of underlying variables, and/or processing for splitting datasets into train, test and validate datasets using at least a stratified sampling technique. The exemplary disclosed system may utilize prediction algorithms and approach that may include regression models, tree-based approaches, logistic regression, Bayesian methods, deep-learning and neural networks both as a standalone and on an ensemble basis, and final prediction may be based on the model/structure which delivers the highest degree of accuracy and stability as judged by implementation against the test and validate datasets.

Throughout this disclosure and elsewhere, block diagrams and flowchart illustrations depict methods, apparatuses (e.g., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "component", "module," or "system."

While the foregoing drawings and description set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

The functions, systems and methods herein described could be utilized and presented in a multitude of languages. Individual systems may be presented in one or more languages and the language may be changed with ease at any point in the process or methods described above. One of ordinary skill in the art would appreciate that there are numerous languages the system could be provided in, and embodiments of the present disclosure are contemplated for use with any language.

While multiple embodiments are disclosed, still other embodiments of the present disclosure will become apparent to those skilled in the art from this detailed description. There may be aspects of this disclosure that may be practiced without the implementation of some features as they are described. It should be understood that some details have not been described in detail in order to not unnecessarily obscure the focus of the disclosure. The disclosure is capable of myriad modifications in various obvious aspects, all without departing from the spirit and scope of the present disclosure. Accordingly, the drawings and descriptions are to be regarded as illustrative rather than restrictive in nature.

What is claimed is:

1. A wearable massager comprising:

a main body having a bottom portion and a convex portion opposing the bottom portion, the convex portion being configured to be in contact with an erogenous zone of a user while the wearable massager is being worn, the bottom portion being configured to face away from the erogenous zone of the user while the wearable massager is being worn, and the bottom portion having a first surface with a first magnet member disposed therein or thereon; and a second magnet member having a second surface corresponding to at least a portion of the first surface, wherein:

the second magnet member is removably attachable to an outer surface of the bottom portion via attraction of the second magnet member to the first magnet member by an attractive force acting in a direction normal to the outer surface of the bottom portion, a button is disposed on the outer surface of the bottom portion so as to face away from the erogenous zone of the user while the wearable massager is being worn, the button being operable to selectively activate the wearable massager, and the main body encases a vibrational component and a printed circuit board.

2. The wearable massager of claim 1, wherein the wearable massager is attachable to an article of clothing by attracting the second magnet member to the first magnet member in a state in which the article of clothing is disposed between the second magnet member and the main body.

3. The wearable massager of claim 1, wherein said selectively activating the wearable massager includes at least one of the following:

causing the vibrational component to vibrate;

powering the wearable massager on or off;

activating short-range wireless communication; and changing an intensity of the vibrational component.

4. The wearable massager of claim 1, wherein the vibrational component is further configured to be remotely controlled based on instructions received from an external device other than the wearable massager, the external device comprising a smart phone or a wireless remote.

5. The wearable massager of claim 4, wherein vibrational data is transmitted from the smart phone or the wireless remote to the printed circuit board via short-range wireless communication.

6. The wearable massager of claim 1, wherein:

a width of the wearable massager is in a range of between 20 mm and 40 mm; and a length of the wearable massager is in a range of between 80 mm and 100 mm;

a height of the wearable massager is in a range of between 10 mm and 30 mm.

7. The wearable massager of claim 1, wherein:

the convex portion and the bottom portion are configured to snap together and are covered with a material comprising silicon or thermoplastic elastomer (TPE), the bottom portion has a charging connector disposed thereon, the main body further encases a rechargeable battery, and the rechargeable battery is electrically connected to the charging connector.

8. The wearable massager of claim 1, wherein the button comprises a push button.

9. The wearable massager of claim 1, wherein the first surface and the second surface are both substantially planar surfaces which become substantially parallel to each other when the second magnet member is attracted to the first magnet member.

10. A wearable massager comprising:

a main body having a bottom portion and a convex portion opposing the bottom portion, the convex portion comprising a protrusion and an oblique surface inclined from the protrusion along a direction toward a lower edge portion of the main body, a bottom of the convex portion contacting with the lower edge portion of the main body, the protrusion and the oblique surface defining a contoured contacting portion adapted to be in ergonomic contact with a vulva of a user when the wearable massager is being worn, the contoured contacting portion defining at least one curved outer surface from a peak of the protrusion along the direction toward the lower edge portion of the main body when viewed in section, and the bottom portion having a first surface with a first magnet member disposed therein or thereon; and a second magnet member having a second surface corresponding to at least a portion of the first surface, wherein:

the second magnet member is removably attachable to an outer surface of the bottom portion via attraction of the second magnet member to the first magnet member by an attractive force acting in a direction normal to the outer surface of the bottom portion, the wearable massager is attachable to an article of clothing by attracting the second magnet member to the first magnet member in a state in which the article of clothing is disposed between the second magnet member and the main body, a button is disposed on the outer surface of the bottom portion so as to face away from the vulva of the user while the wearable massager is being worn, the button being operable to selectively activate the wearable massager, and the main body encases a vibrational component and a printed circuit board.

11. The wearable massager of claim 10, wherein the printed circuit board is configured to transmit and receive vibrational data.

12. The wearable massager of claim 10, wherein said selectively activating the wearable massager includes at least one of the following:

causing the vibrational component to vibrate;

powering the wearable massager on or off;

activating short-range wireless communication; and changing an intensity of the vibrational component.

13. The wearable massager of claim 10, wherein the vibrational component is further configured to be remotely controlled based on instructions received from an external device other than the wearable massager, the external device comprising a smart phone or a wireless remote.

14. The wearable massager of claim 13, wherein vibrational data is transmitted from the smart phone or the wireless remote to the printed circuit board via short-range wireless communication.

15. The wearable massager of claim 10, wherein:

a width of the wearable massager is in a range of between 20 mm and 40 mm;

a length of the wearable massager is in a range of between 80 mm and 100 mm; and a height of the wearable massager is in a range of between 10 mm and 30 mm.

16. The wearable massager of claim 10, wherein:

the bottom portion has a charging connector disposed thereon, the main body further encases a rechargeable battery, and the rechargeable battery is electrically connected to the charging connector.

17. A wearable massager comprising:

a main body having a bottom portion and a convex portion opposing the bottom portion, the convex portion being configured to be in contact with an erogenous zone of a user while the wearable massager is being worn, the bottom portion being configured to face away from the erogenous zone of the user while the wearable massager is being worn, the bottom portion having a first surface with a first magnet member disposed therein or thereon, the bottom portion having a charging connector disposed thereon, and the convex portion and the bottom portion being configured to snap together and being covered with a material comprising silicon or thermoplastic elastomer (TPE); and a second magnet member having a second surface corresponding to at least a portion of the first surface, wherein:

the second magnet member is removably attachable to an outer surface of the bottom portion via attraction of the second magnet member to the first magnet member by an attractive force acting in a direction normal to the outer surface of the bottom portion, a button is disposed on the outer surface of the bottom portion so as to face away from the erogenous zone of the user while the wearable massager is being worn, the button being operable to selectively activate the wearable massager, the main body encases a vibrational component, a printed circuit board, and a rechargeable battery, and the rechargeable battery is electrically connected to the charging connector.

18. The wearable massager of claim 17, wherein the printed circuit board is configured to transmit and receive vibrational data.

19. The wearable massager of claim 17, wherein said selectively activating the wearable massager includes at least one of the following:

causing the vibrational component to vibrate;

powering the wearable massager on or off;

activating short-range wireless communication; and changing an intensity of the vibrational component.

20. The wearable massager of claim 17, wherein:

the vibrational component is further configured to be remotely controlled based on instructions received from an external device other than the wearable massager, the external device comprises a smart phone or a wireless remote, and vibrational data is transmitted from the smart phone or the wireless remote to the printed circuit board via short-range wireless communication.

21. The wearable massager of claim 17, wherein the wearable massager is attachable to an article of clothing by attracting the second magnet member to the first magnet member in a state in which the article of clothing is disposed between the second magnet member and the main body.

* * * * *